US010822806B2

(12) United States Patent
Czyż

(10) Patent No.: US 10,822,806 B2
(45) **Date of Patent: *Nov. 3, 2020**

(54) ANCHOR-FREE SYSTEM FOR FASTENING OF CLADDING PANELS AND A METHOD OF FASTENING THEREOF

(71) Applicant: Wido-Profil—Spółka z ograniczoną odpowiedzialnością, Myślenice (PL)

(72) Inventor: Michał Czyż, Libertów (PL)

(73) Assignee: Wido-Profil—Spółka z ograniczoną odpowiedzialnością, Myślenice (PL)

( * ) Notice: Subject to any disclaimer, the term of this patent is extended or adjusted under 35 U.S.C. 154(b) by 0 days.

This patent is subject to a terminal disclaimer.

(21) Appl. No.: 16/840,564

(22) Filed: Apr. 6, 2020

(65) Prior Publication Data

US 2020/0318358 A1 Oct. 8, 2020

Related U.S. Application Data

(63) Continuation of application No. 16/307,644, filed as application No. PCT/PL2017/000058 on May 30, 2017, now Pat. No. 10,612,246.

(30) Foreign Application Priority Data

Jun. 10, 2016 (PL) ..... PLP.417531

(51) Int. Cl.
*E04F 13/08* (2006.01)

(52) U.S. Cl.
CPC ..... *E04F 13/0819* (2013.01); *E04F 13/083* (2013.01)

(58) Field of Classification Search
CPC . E04F 13/0816; E04F 13/0819; E04F 13/083; E04F 13/081
See application file for complete search history.

(56) References Cited

FOREIGN PATENT DOCUMENTS

| | | | | |
|---|---|---|---|---|
| CA | 2799496 A1 * | 12/2011 | ..... | E04B 2/88 |
| CN | 103938830 A * | 7/2014 | | |
| DE | 9300004 U1 * | 5/1994 | ..... | E04F 13/0816 |
| EP | 0547208 B1 * | 12/1995 | ..... | E04F 13/0819 |
| FR | 761054 A * | 3/1934 | ..... | E04F 13/0855 |
| WO | WO-9301418 A1 * | 1/1993 | ..... | E04F 13/0819 |

* cited by examiner

*Primary Examiner* — Christine T Cajilig
(74) *Attorney, Agent, or Firm* — Ziegler IP Law Group, LLC

(57) ABSTRACT

A system for fastening a cladding panel includes a base profile and a two-element hanger with an upper element and a bottom element. The upper element has a first lateral wall, a first tongue extending out from the first lateral wall, a first shelf connected to the first lateral wall and a first opening for an adjustment bolt. The bottom element has two lateral walls, a second tongue extending out from one of the two lateral walls, and a second shelf connecting the two lateral walls and having a second opening for the adjustment bolt. The first shelf and the second shelf are connected to each other. The base profile is received in a space defined by the two lateral walls. The first tongue and the second tongue form an angle, and are received in respective installation grooves on a non-visible side of the cladding panel.

21 Claims, 11 Drawing Sheets

ANCHOR-FREE SYSTEM FOR FASTENING OF CLADDING PANELS AND A METHOD OF FASTENING THEREOF

FIELD

The aspects of the disclosed embodiments relate to an anchor-free system for fastening of cladding panels and a method of fastening thereof. The aspects of the disclosed embodiments are specifically applied while fastening cladding panels of an exterior façade in a way ensuring safety of users and third parties.

BACKGROUND

In the state of the art, façade panels are riveted to a metal substructure, usually an aluminum one. This solution allows one to fasten different sizes of panels. Panels are riveted to a main metal structure. Façade panels are also fastened mechanically, which is invisible to the eye. This method requires that two types of structure be used: a specially profiled metal substructure and horizontal elements fastening a façade panel with specially profiled hangers or connectors. There are also known systems for attaching cladding panels by means of fixation elements inside the material, frontal fixation elements or adhesives used to attach cladding panels to building walls.

Polish patent PL 172761, Method of and system for fastening façade panels to panel structures, discloses a method of fastening façade panels to panel structures, especially façade panels situated on an insulation layer of building panels, comprising a conical metal part placed in a cut-through cylinder sleeve, located in a pass-through hole of a façade and a blind hole in a building panel.

Polish patent PL 193826, A set for fastening cladding panels, discloses a system provided with multiple reinforcement supports of a cladding panel and multiple handles attached to the surface clad and forming a setting support for a cladding panel, as well as multiple connectors that detachably couple reinforcing supports and handles. Each handle has a rigid body attached to a surface clad and is provided with an exterior part adhering to a connector. Interior and exterior elements of handle bodies are flexible to the extent enabling limited movement of a cladding panel relative to the surface clad. A coupling member of each connector has the shape of a V-section and a support member coupled with it has a pair of mutually divergent and interior facing recesses, which results in their slideable coupling.

According to the Polish patent no. PL 203303, System for attaching panels, especially façade panels, to building and/or structure walls, there is known a system made of a bracket, a main façade element and panel fixing elements. The bracket is formed of an anchor, whose one end is bolted detachably to a building wall, and the other end is bolted to a guide in the central part of the bracket's main section, to the opposite wall of which in the bottom there is bolted another anchor with the other end bolted to the façade's main section. The bracket's anchor has the form of an element provided with three elongated openings. The bracket's main section and the façade's main section have the form of a vertical and/or horizontal hollow column with eight ledges. The ledges form three guides on both sides of the column, said guides placed in the central and lateral side of the wall. Two longer walls of sections are positioned in angular arrangement relative to each other in a cross-sectional view. Hitch supports have the form of elements provided with an elongated part, provided with equally sized ledges over its entire length, and with one longer end ledge.

According to the Polish utility model no. PL 67992Y1, System for fastening façade panels, there is known a system for fastening façade panel and other wall cladding used indoors and outdoors. The system is provided with C-shaped main strips with an adjustment bolt. In the system, the fixing strip and the movable main strip are provided with an upper edge foldable to the outside of the section at an acute angle, said edge having a rounded rim, and in the bottom part of the strips, there is a U-shaped elongated groove inside the section, next to which in parallel arrangement there is a longitudinal channel having C-shaped cross section, said channel provided with stopping edges.

According to the Polish patent application no. P.395336, System for fastening façade panels, there is known a system of elements composed of support façade panels and main rails with adjustments sockets, said supports and rails fixed detachably and alternately to building walls. Vertical main rails of the system are on the one side fixed to a façade panel with stabilization handles and fixing anchors. On the other side vertical main rails of the system are fixed to the main wall with angular connecting members on the other side. Fixing anchors are placed in conical sockets, and angular connecting members are bolted to the main wall.

The drawback of solutions known in the art consists in the lack of a simple, fast and anchor-free system for fastening of panel elements, both for interior and exterior façades. According to the art, there are no systems of necessary elements making it possible to fix them without anchors to the insides of cladding panels.

SUMMARY

The purpose of the disclosed embodiments are to present an anchor-free system for fastening of cladding panels, and a method of fastening cladding panels to buildings, which will make it possible to provide robust and low expenditure fastening of any kind of façade panels, especially heavy-weight façade panels, and will assure full safety for users.

An anchor-free system for fastening of cladding panels according to the invention is made of a profiled metal substructure, a metal base profile, to which two-element hangers are attached. Two-element hangers have the form of an upper element coupled with a bottom element, advantageously with a screw. The contact surface of this connection forms a horizontal or inclined ledge, the central part of which is advantageously provided with an opening to accommodate an adjustment bolt. The hanger's upper element has the form of a vertical wall closed in the bottom with a horizontal or inclined shelf with an opening for a screw and, advantageously, an opening to accommodate an adjustment bolt. The vertical wall of the hanger's upper element has at least one tongue placed at an angle relative to the vertical surface of the hanger's upper element's vertical wall. The hanger's bottom element has the form of two vertical walls connected in the top part with a horizontal or vertical shelf with openings for screws and, advantageously, for an adjustment bolt. The vertical wall of the bottom element makes a hitch for the base profile of the installation substructure. The vertical wall of the hanger's bottom element has at least one tongue at an angle relative to the vertical surface of the bottom element of the hanger. Each cladding panel is provided with incised installation grooves for tongue fixing on the side not visible to the eye.

An anchor-free system for fastening of cladding panels according to the invention is advantageously composed of a metal base profile, to which two-element hangers are fixed. Each hanger is composed of a hanger's upper element and a hanger's bottom element, wherein each of them on the side of contact with invisible surface of a cladding panel is provided with a tongue (tongues) protruding outside the hanger. After the upper and the bottom element of the hanger are connected, the tongues of these two elements, which protrude to the outside, are directed at an angle towards the center of the hanger or at an angle to the outside of the hanger's center. The hanger's upper element has the form of a profile composed of a vertical wall closed with a shelf in the bottom part with openings to accommodate screws or a horizontal shelf with openings to accommodate screws and an adjustment bolt to adapt the height of suspension of a cladding panel. The vertical wall of the hanger's upper element, on the side of contact with the invisible inside surface of a cladding panel, is provided with a tongue (tongues) at an angle relative to the profile's upper wall. The horizontal shelf of the hanger's upper element, said hanger being favorably an aluminum profile, on the side of contact with a horizontal shelf of the hanger's bottom element with said hanger being advantageously an aluminum profile, is provided with profiled and protruding two or more ledges to be inserted in profiled grooves on the outside surface of the horizontal shelf of the hanger's bottom element. The hanger's upper and bottom elements are permanently joined together, advantageously with rivets, screws or fixing bolts. The hanger's bottom element has the form of two vertical walls connected with a shelf in the upper part, said shelf having openings to accommodate screws, or openings to accommodate screws and an adjustment bolt. Advantageously, the shelf, where the hanger's upper element and bottom element are joined, is at an angle to the level line. The smooth outside vertical wall is a hitch making it possible to attach the hanger to the base profile, which is only one of the elements of the substructure. The horizontal shelf of the bottom element is also provided with profiled grooves for engaging protruding ledges of the bottom part of the horizontal shelf of the hanger's upper element. On the side of contact with the invisible inside surface of a cladding element, the vertical wall of the bottom element of the hanger is provided with a tongue or tongues located one after another at an angle relative to the vertical wall of the hanger's bottom profile. Advantageously, the length of each tongue of the two-element hanger corresponds to the hanger's width, or there are two or more tongues along the hanger, whose total length is not greater than the width of the two-element hanger. The tongues of the two-element hanger are engaged in the grooves on the invisible surface of a cladding element. Lengths and widths of the grooves on the invisible surface of a cladding element correspond to lengths and widths of the two-element hanger's tongue engaged therein. Advantageously, prior to engagement of the two-element hanger's tongue in the groove of a cladding panel, the groove is filled in with an adhesive.

Advantageously, two-element hangers are made of extruded aluminum profiles, casts or steel plate.

The two-element hanger's tongues are arranged at different spans, depending on the type of panel. Wider span of the two-element hanger's tongues, due to greater working surface with mechanical stresses, results in a higher value of force pulling the tongues out of the panel. The tongues have different widths, advantageously from one to several centimeters. Wider hangers, due to greater working surface with mechanical stresses, are characterized by a higher value of force pulling them out of the panel. These features can be combined by extending the span of the tongues and at the same time increasing tongue's width.

Another variation of the two-element hanger, is a hanger made of a specially profiled metal plate, with its upper element being a horizontal or inclined shelf, which on the invisible surface of a cladding panel is closed with a tongue placed at an angle and directed towards the inside of the hanger or the outside of the hanger. The hanger's shelf is provided with openings to accommodate screws or openings to accommodate screws and an adjustment bolt. The alternative hanger's bottom element is a bent metal profile in the form of two vertical walls connected with a shelf on the top, said shelf having openings to accommodate screws or openings to accommodate screws and an adjustment bolt. The bottom part of the hanger's vertical wall has a curve on the invisible surface of a cladding panel, which is a tongue aligned or misaligned relative to the tongue of the hanger's upper element.

In another variation of the two-element profiled hanger made of metal plate, the upper element of the variation is a curved profile bent from a metal plate, having a vertical wall closed in the bottom with a shelf with openings to accommodate screws or a shelf with openings to accommodate screws and an adjustment bolt fixing the suspension height of a cladding panel. In the area of contact with the invisible surface of a cladding panel, the vertical wall of the upper element in this variation is provided with a tongue or tongues formed as a result of bending the previously cut metal plate at an angle relative to the vertical wall of the upper element in this variation. The bottom element of the hanger's variation is a bent metal plate profile, made of two vertical walls connected in the top with a shelf having openings to accommodate screws or openings to accommodate screws and an adjustment bolt. On the side of contact with the invisible inside surface of a cladding element, the vertical wall of the bottom element in the embodiment is provided with a tongue formed by bending the previously cut metal plate at an angle relative to the vertical wall of the bottom element in the variation. The curved tongue is at an angle relative to the vertical wall of the bottom element in the variation. The tongue is at an angle and directed inside the hanger's variation or outside the hanger's variation.

Tongues engaged in the grooves are an integral part of the two-element hanger and replace an installation anchor.

Installation grooves are cut only in the sections corresponding to the tongue's length. Installation grooves are not preset over the entire length of the invisible surface of a cladding panel, therefore the cladding panel is not less strong over its entire length along the installation groove.

A method of fastening an anchor-free system for fastening of cladding panels consists in gouging at least two installation grooves on the invisible surface of a cladding element, said grooves being directed at an angle towards the inside of the invisible surface of a cladding element. Installation grooves have the form of an elongated incision, advantageously with a length and width corresponding to length and width of a tongue of a two-element hanger. Afterwards, the tongue of the hanger's bottom element is inserted at a proper angle in one of the installation grooves. The tongue forms a part of a hitch. After that, along the direction of another groove's installation depth, in line with the direction of the installation groove, the tongue of the hanger's upper element is inserted. This tongue forms the remaining part of the hitch. Afterwards, the upper and the bottom element of the hanger are riveted, screwed or bolted together. Each component of the two-element hanger is attached to the invisible surface of a cladding element in line with the direction of an installation groove.

Advantageously, gouged installation grooves are filled in with an adhesive. Advantageously, the invisible surface of contact between a cladding element and vertical walls of the two-element hanger is also covered with an adhesive.

In another variation of the method, where one of the grooves has the length twice the length of a tongue engaged therein, the other hanger element has to be moved to the side so that it can be positioned under the former hanger element.

Advantageously, the length and width of every elongated installation groove of the two-element hanger corresponds to the width and length of the tongue engaged in the two-element hanger and makes it possible to freely position the tongue in the installation groove.

Each two-element hanger is provided with a tongue, the inclination of which corresponds to the angle of the installation groove made in the invisible surface of a cladding panel.

Installation grooves for engaging a two-element hanger are made at an angle relative to the invisible surface of a cladding element and are either converging or diverging towards each other.

The method of fastening an anchor-free system for fastening cladding panels is used safely for cladding panels with lower mechanical parameters, where the anchor is characterized by too low pull-out or shear resistance and therefore is not admitted for use. The method according to the invention makes it possible to select a depth of an installation groove, enables mutual arrangement of grooves by achieving a required span between them and makes it possible to select groove's length and width as well as an angle relative to the panel surface depending on the type and structure of a cladding panel and its thickness.

Elements of a two-element hanger are riveted, screwed, glued or connected thanks to a specially profiled parts where a tongue and inlet type of connection is used along the direction of inserting the protruding part of the other hanger's element. The anchor-free two-element hanger is attached to metal base profiles of a façade substructure or directly to a main wall.

Two-element hangers arranged as points can move freely in a horizontal direction relative to the metal base profile being part of a substructure and performing the function of mechanical fixation.

Advantageously, two-element hangers are hung on metal base profiles, special profiles, standard hollow profiles, angles or channels, and directly on the wall.

While mounting two-element hangers with an adjustment bolt, they are advantageously placed in top corners of a cladding panel, one in each corner. For large-size cladding panels, multiple two-element hangers with an adjustment bolt are used. Two-element hangers with an adjustment bolt rest on a base profile via an adjustment bolt. Shelves of two-element hangers without an adjustment bolt do not rest on base profiles. Two-element hangers are mounted on a base profile but their shelves do not rest on a base profile. Thus, it is possible to compensate the dimensions of a cladding panel due to thermal expansion or absorbability of a cladding panel.

Base profiles are attached to building walls or other support substructures, which enable installation of an insulation.

An advantage of an anchor-free system for fastening of cladding panels, as well as fastening of a cladding panel element is a simple structure of a hanger and an easy method of installing cladding panels. An anchor-free hanger, which is one of the elements for mounting cladding panels, makes it possible to fasten cladding panels in a safe way. When it comes to mechanical load, safety is achieved by spreading pull-out or shear stresses over a much greater surface than it is the case for anchors used in the art. Moreover, a greater area of tongues used, influenced by mechanical forces, leads to a much higher mechanical strength when coupled with a cladding panel. Insertable tongues are an integral part of the hanger and replace an installation anchor. Lack of an additional element in the form of an anchor makes it possible to fasten cladding panel elements in a faster way and is cheaper thanks to the use of the solution covered by this invention. Another advantage is also a possibility to increase mechanical strength of hanger fixation either by increasing a number of installation grooves per one hanger by placing them vertically relative to each other, or by inserting more tongues of two-element hangers into grooves, which increases working surface of a panel. Additional tongues can be introduced vertically or horizontally relative to a hanger.

BRIEF DESCRIPTION OF THE DRAWINGS

Anchor-free system for fastening cladding panels and a method of its fastening has been disclosed in a drawing, where.

BRIEF DESCRIPTION OF DISCLOSED EMBODIMENTS

Figure 1:
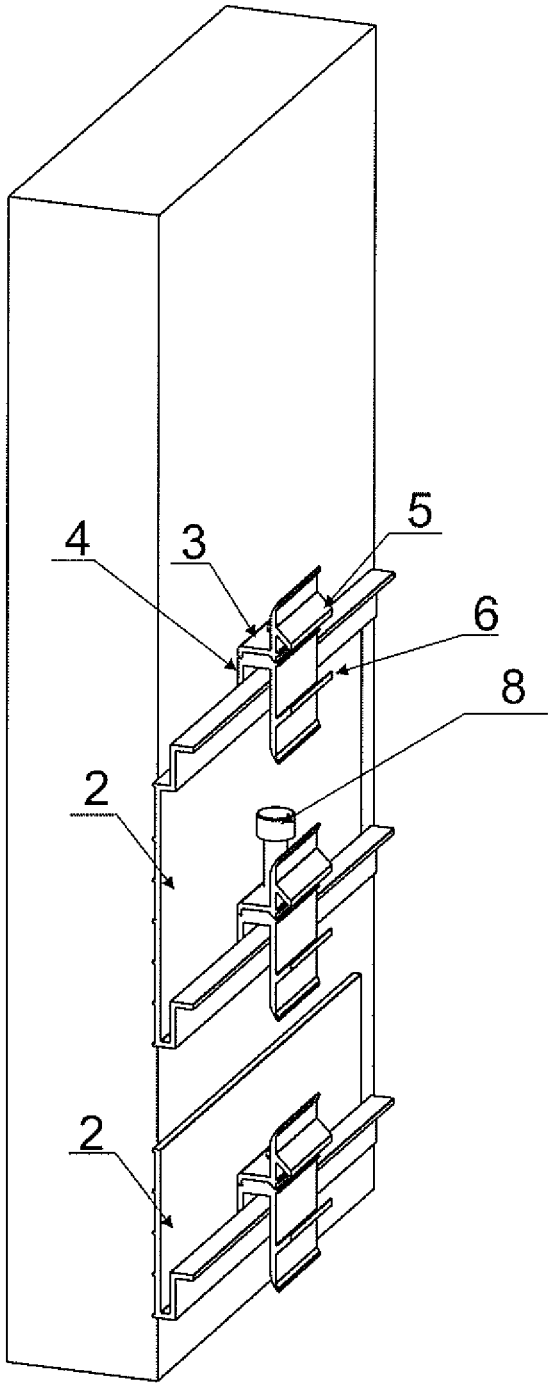
FIG. 1 shows an anchor-free system for fastening of cladding panels.
Figure 2:
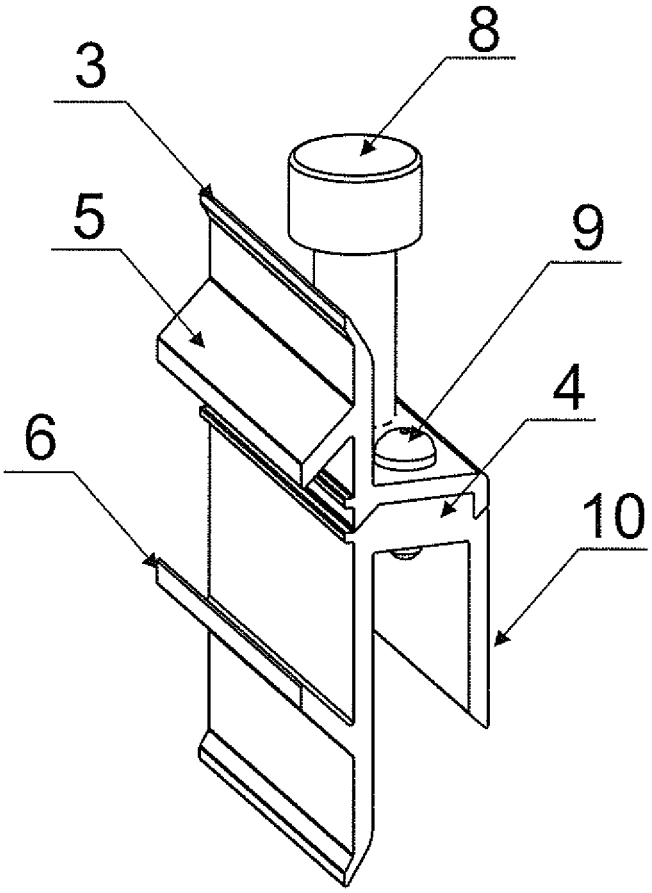
FIG. 2 shows a two-element hanger with an adjustment bolt.
Figure 3:
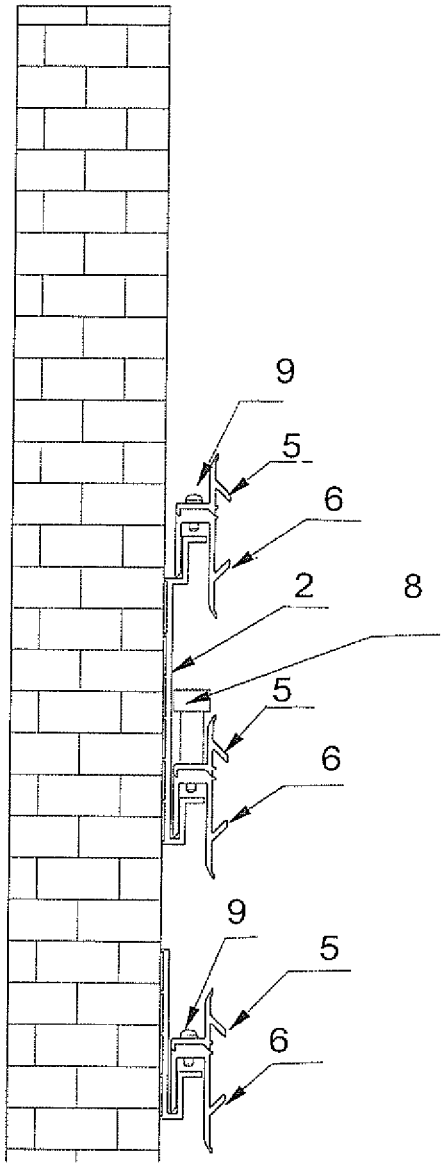
FIG. 3 and FIG. 4 show installation of cladding panels with the use of a fastening system.
Figure 4:
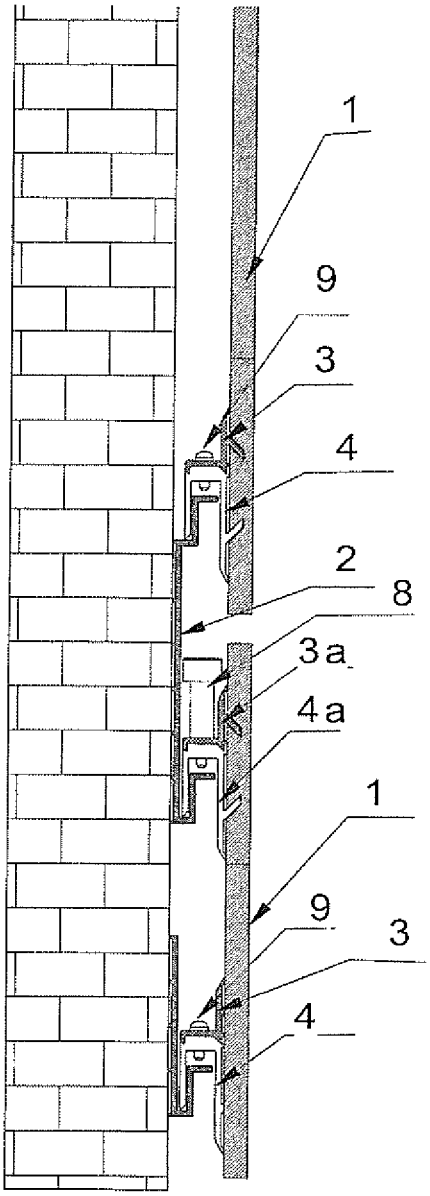
Figure 5:
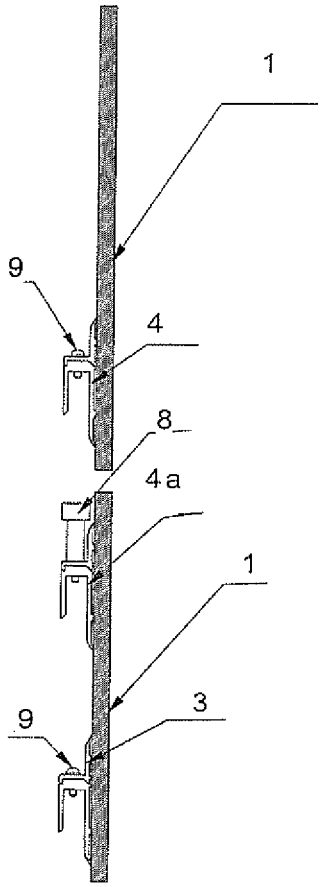
FIG. 5 and FIG. 6 show installation of a two-element hanger on a cladding panel.
Figure 6:
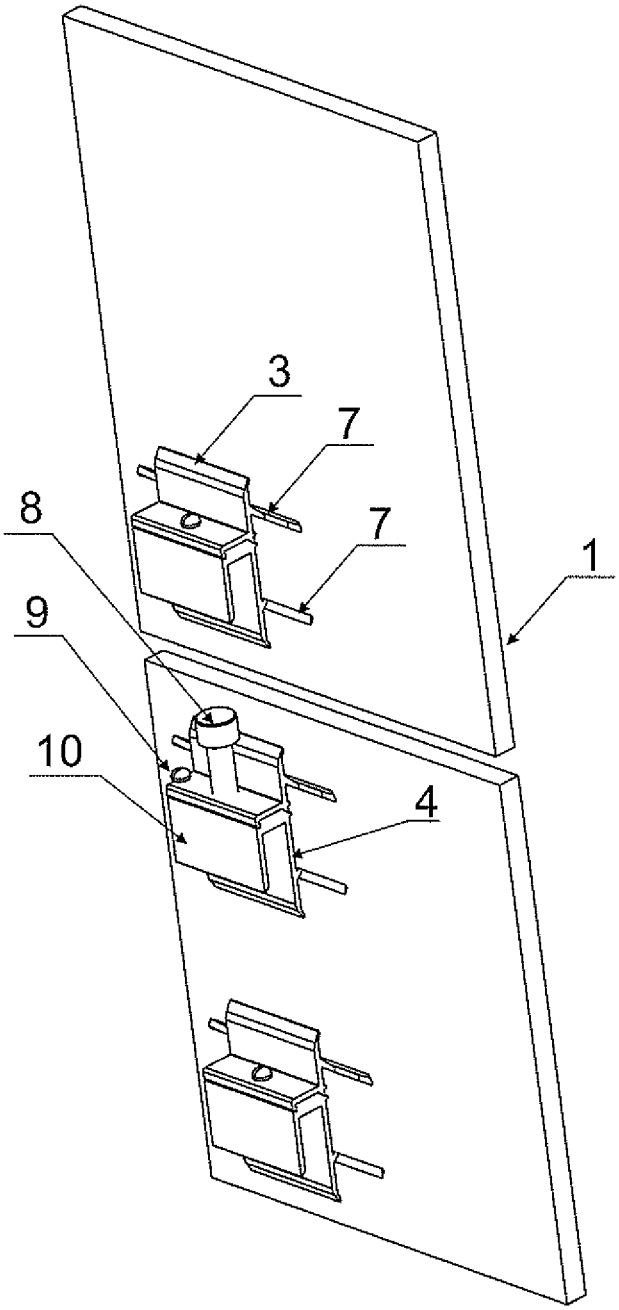
Figure 7:
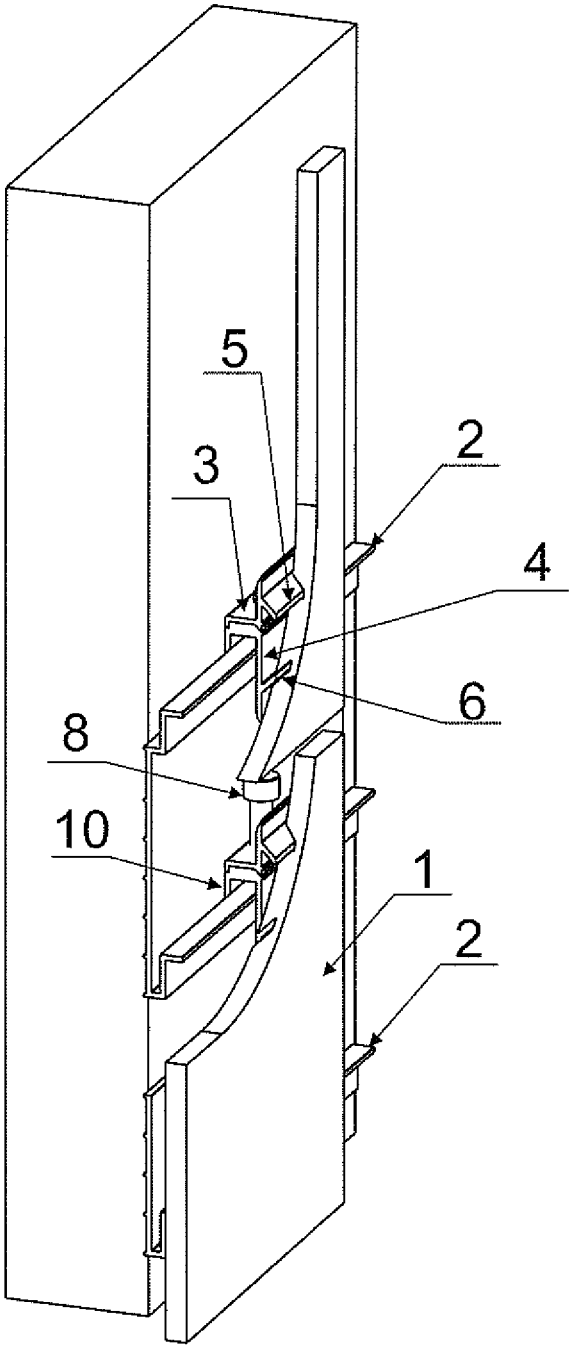
FIG. 7 shows a section of exterior façade with cladding panels attached on hangers.
Figure 8:
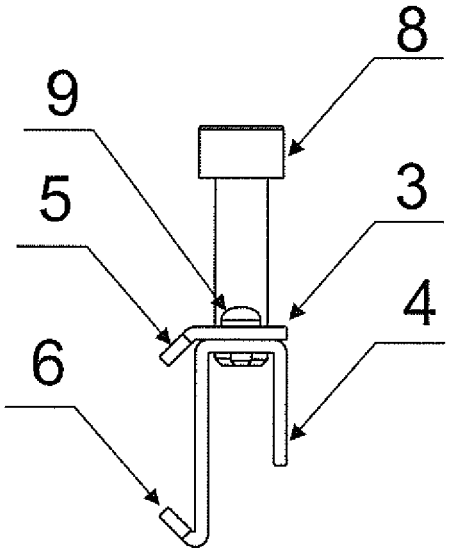
FIG. 8 shows a variation of a two-element hanger made of profiled metal plate.
Figure 9:
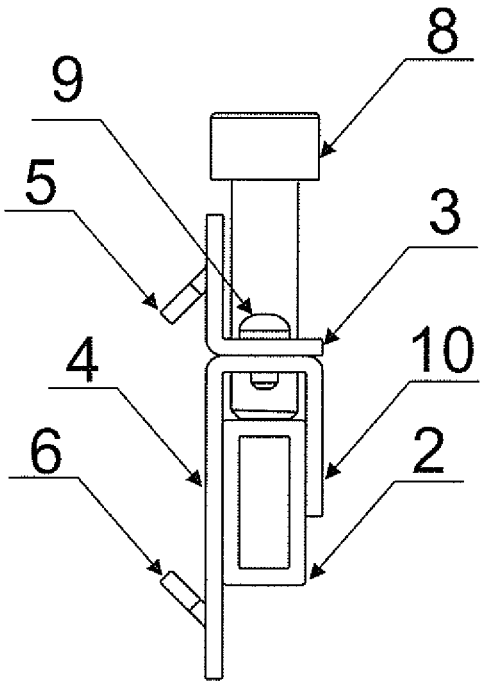
FIG. 9 shows another variant of a two-element hanger made of profiled metal plate.
Figure 10:
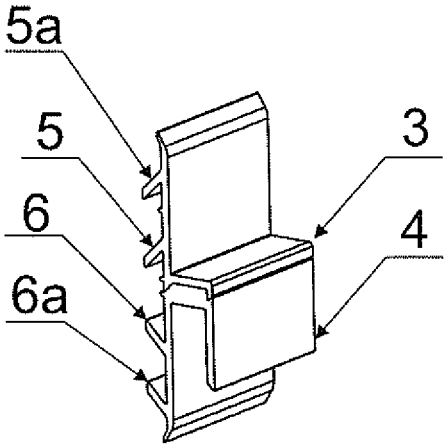
FIG. 10 shows a two-element hanger with double rows of installation tongues.
Figure 11:
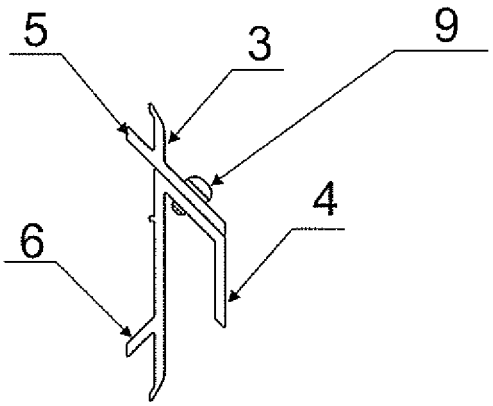
FIG. 11 shows a hanger made of profiled metal plate with an inclined shelf.
Figure 12:
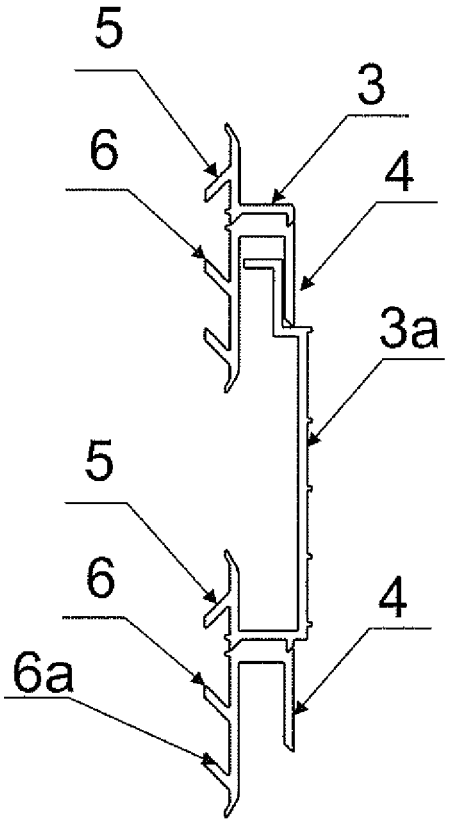
FIG. 12 and FIG. 13 show top elements of a hanger attached to a wall or a profile.
Figure 13:
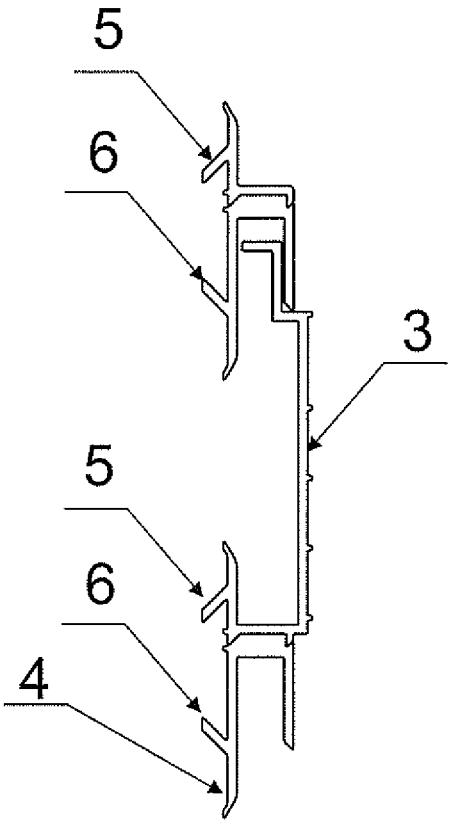
Figure 14:
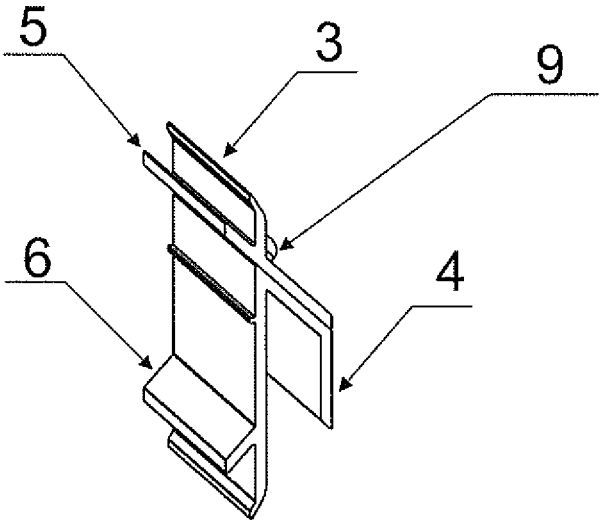
FIG. 14 shows a two-element hanger with diverging tongues.
Figure 15:
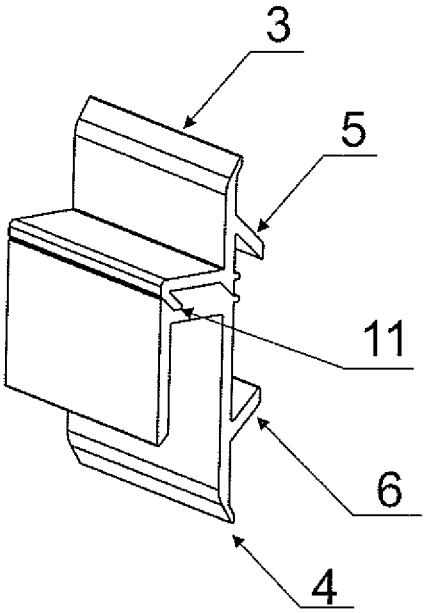
FIG. 15, FIG. 16 and FIG. 17 show a two-element hanger joined with a protruding ledge.
Figure 16:
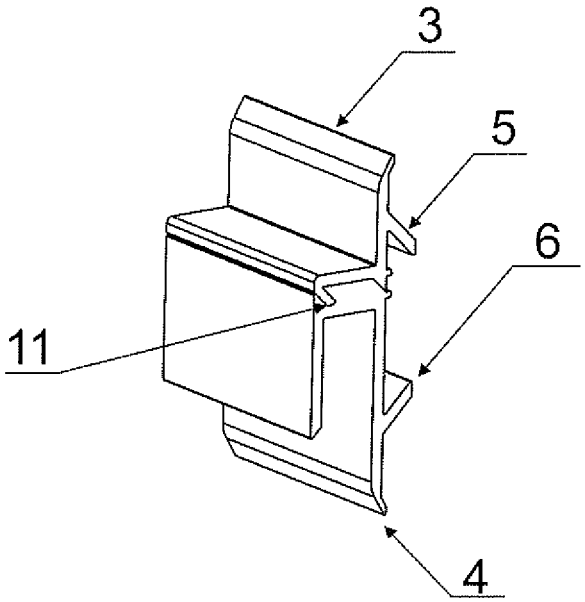
Figure 17:
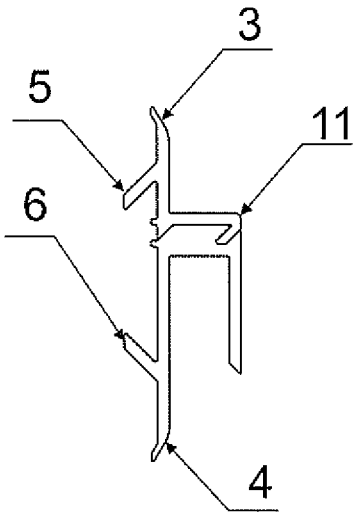
Figure 18:
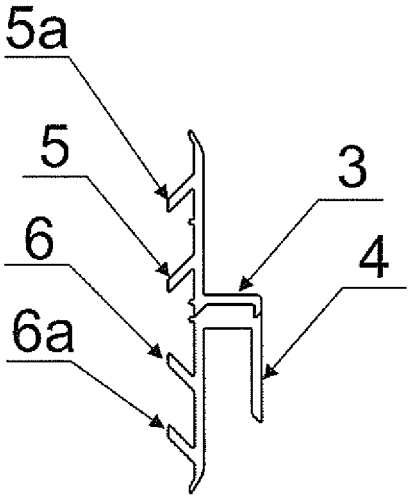
FIG. 18 shows a two-element hanger with double rows of tongues.
Figure 19:
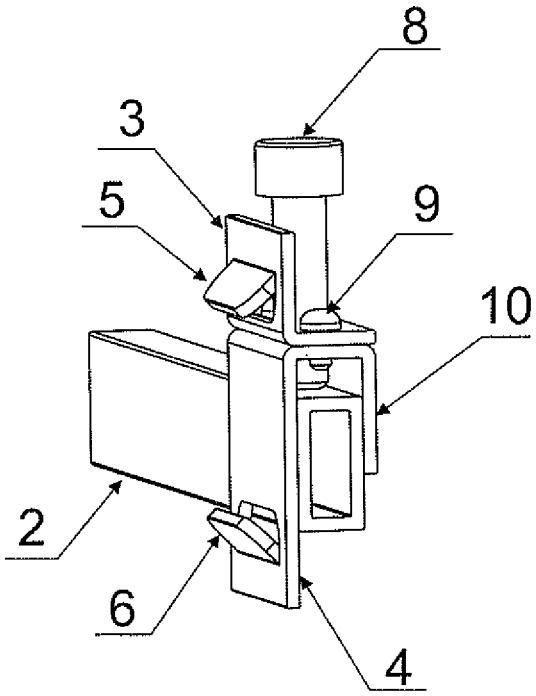
FIG. 19 shows a hanger with an adjustment bolt.
Figure 20:
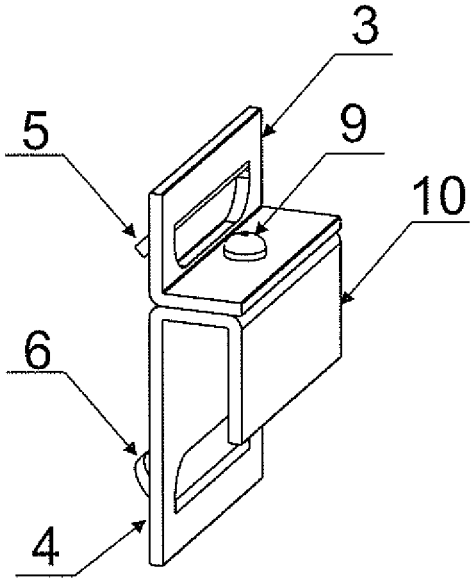
FIG. 20 and FIG. 21 show two-element hangers with tongues in the form of metal plate elements bent aside.
Figure 21:
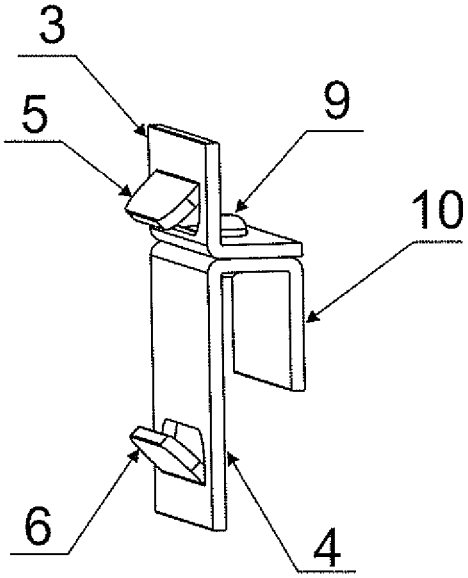

The anchor-free system for fastening of cladding panels is composed of a metal base profile 2, to which two-element hangers 3 and 4 are attached. The upper element of the hanger 3 is connected with the bottom element of the hanger 4 with a screw 9. In the central part of a connection shelf of the upper element of the adjustment hanger 3 with the bottom element of the adjustment hanger 4 there is an opening to accommodate an adjustment bolt 8. The upper element of the hanger 3 is made of a vertical wall closed in the bottom with a horizontal shelf with openings for screws 9. Vertical wall of the upper element of the hanger 3 is provided with a tongue 5, 5*a* located at an angle relative to the surface of the vertical wall of the upper element of the hanger 3. The bottom element of the hanger 4 is made of two vertical walls connected in the top with a horizontal shelf having openings for screws 9. The vertical wall of the bottom element 10 forms a hitch for a base profile. The vertical wall of the bottom element of the hanger 4 has a tongue 6, 6*a* located at an angle relative to the surface of the vertical wall of the bottom element of the hanger 4. In the area of contact between the upper element of the hanger 3 with the bottom element of the hanger 4, there is a ledge 11. The upper element of the hanger 3 is an installation profile 3 enabling installation to a wall or a metal base profile 2.

What is claimed is:

1. A system for fastening a cladding panel, comprising:

a base profile; and a two-element hanger comprising an upper element and a bottom element, wherein the upper element comprises a first lateral wall, at least one first tongue extending out from the first lateral wall, and a first shelf connected to the first lateral wall and having a first opening for an adjustment bolt, wherein the bottom element comprises two lateral walls, at least one second tongue extending out from one of the two lateral walls, and a second shelf connecting the two lateral walls and having a second opening for the adjustment bolt, wherein when the system is in use, the first shelf and the second shelf are connected to each other, the base profile is received in a space defined by the two lateral walls of the bottom element, the at least one first tongue and the at least second tongue form an angle, and the at least one first tongue and the at least one second tongue are received in respective installation grooves on a non-visible side of the cladding panel.

2. The system of claim 1, wherein after the first shelf and the second shelf are connected to each other, the at least one first tongue and the at least one second tongue converge towards each other or diverge from each other.

3. The system of claim 1, wherein the first shelf comprises a ledge on a bottom side thereof, and the second shelf has a recess to receive the ledge.

4. The system of claim 1, wherein when the system is in use, the first shelf and the second shelf are horizontally disposed.

5. The system of claim 1, wherein when the system is in use, the first shelf and the second shelf are inclined.

6. The system of claim 1, wherein a length of each tongue of the two-element hanger corresponds to a width of the two-element hanger, and the tongues are placed one under another or along the width of the two-element hanger and in one row, where two or more tongues are accommodated.

7. The system of claim 1, wherein a length and a width of each installation groove located on the non-visible side of the cladding panel correspond to a length and a width of the respective tongue of the two-element hanger, respectively.

8. The system of claim 1, wherein the adjustment bolt is received in the first opening and the second opening, and is used to adjust a vertical position of the cladding panel relative to the base profile.

9. A system for fastening a cladding panel, comprising:

a base profile; and a two-element hanger comprising an upper element and a bottom element, wherein the upper element comprises a first shelf having a first opening for an adjustment bolt, and at least one first tongue extending out from the first shelf, wherein the bottom element comprises two lateral walls, at least one second tongue extending out from one of the two lateral walls, and a second shelf connecting the two lateral walls and having a second opening for the adjustment bolt, wherein when the system is in use, the first shelf and the second shelf are connected to each other, the base profile is received in a space defined by the two lateral walls of the bottom element, the at least one first tongue and the at least second tongue form an angle, and the at least one first tongue and the at least one second tongue are received in respective installation grooves on a non-visible side of the cladding panel.

10. The system of claim 9, wherein after the first shelf and the second shelf are connected to each other, the at least one first tongue and the at least one second tongue converge towards each other or diverge from each other.

11. The system of claim 9, wherein the first shelf comprises a ledge on a bottom side thereof, and the second shelf has a recess to receive the ledge.

12. The system of claim 9, wherein when the system is in use, the first shelf and the second shelf are horizontally disposed.

13. The system of claim 9, wherein when the system is in use, the first shelf and the second shelf are inclined.

14. The system of claim 9, wherein a length of each tongue of the two-element hanger corresponds to a width of the two-element hanger, and the tongues are placed one under another or along the width of the two-element hanger and in one row, where two or more tongues are accommodated.

15. The system of claim 9, wherein a length and a width of each installation groove located on the non-visible side of the cladding panel correspond to a length and a width of the respective tongue of the two-element hanger, respectively.

16. The system of claim 9, wherein the two-element hanger is cast, has an extruded profile or is extruded from a steel plate.

17. The system of claim 9, wherein the first shelf and the second shelf are connected to each other by one or more of rivets, screws, adhesive or a tongue and inlet type of connection in a direction of ledge insertion into the second shelf.

18. The system of claim 1, wherein the adjustment bolt is received in the first opening and the second opening, and is used to adjust a vertical position of the cladding panel relative to the base profile.

19. A system for fastening a cladding panel, comprising:

a base profile; and a two-element hanger comprising an upper element and a bottom element, wherein the upper element comprises a first lateral wall, at least one first tongue extending out from the first lateral wall, and a first shelf connected to the first lateral wall, wherein the bottom element comprises two lateral walls, at least one second tongue extending out from one of the two lateral walls, and a second shelf connecting the two lateral walls, wherein when the system is in use, the first shelf and the second shelf are connected to each other, the base profile is received in a space defined by the two lateral walls of the bottom element, the at least one first tongue and the at least second tongue form an angle, and the at least one first tongue and the at least one second tongue are received in respective installation grooves on a non-visible side of the cladding panel.

20. The system of claim 1, wherein the two-element hanger is cast, has an extruded profile or is extruded from a steel plate.

21. The system of claim 1, wherein the first shelf and the second shelf are connected to each other by one or more of rivets, screws, adhesive or a tongue and inlet type of connection in a direction of ledge insertion into the second shelf.

* * * * *